US007139497B2

(12) United States Patent
Takehara

(10) Patent No.: US 7,139,497 B2
(45) Date of Patent: Nov. 21, 2006

(54) COLOR IMAGE FORMING APPARATUS HAVING A VARIABLE CONTROLLED SPEED RATIO

(75) Inventor: Atsushi Takehara, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 215 days.

(21) Appl. No.: 10/724,099

(22) Filed: Dec. 1, 2003

(65) Prior Publication Data

US 2004/0156653 A1 Aug. 12, 2004

(30) Foreign Application Priority Data

Dec. 9, 2002 (JP) ..... 2002-356216

(51) Int. Cl.
*G03G 15/16* (2006.01)

(52) U.S. Cl. ..... 399/66; 399/167; 399/302

(58) Field of Classification Search ..... None
See application file for complete search history.

(56) References Cited

U.S. PATENT DOCUMENTS

| | | | | |
|---|---|---|---|---|
| 5,010,372 | A * | 4/1991 | Kasahara et al. | 399/78 |
| 5,313,252 | A | 5/1994 | Castelli et al. | |
| 5,508,789 | A | 4/1996 | Castelli et al. | |
| 6,154,628 | A * | 11/2000 | Kawano | 399/301 |
| 6,160,569 | A * | 12/2000 | Fujimori et al. | 347/262 |
| 6,226,465 | B1 * | 5/2001 | Funatani | 399/44 |
| 6,249,304 | B1 | 6/2001 | Sawayama et al. | |
| 6,292,206 | B1 | 9/2001 | Takehara et al. | |
| 6,295,438 | B1 | 9/2001 | Fujishiro et al. | |
| 6,334,039 | B1 | 12/2001 | Yoshinaga et al. | |
| 6,366,754 | B1 | 4/2002 | Sato et al. | |
| 6,885,832 | B1 * | 4/2005 | Osada | 399/45 |
| 2002/0025179 | A1 | 2/2002 | Toyohara et al. | |

FOREIGN PATENT DOCUMENTS

| | | | |
|---|---|---|---|
| EP | 0 432 476 | | 6/1991 |
| EP | 1 031 892 | | 8/2000 |
| JP | 07219292 | A * | 8/1995 |
| JP | 10-186786 | | 7/1998 |
| JP | 2000155516 | A * | 6/2000 |
| JP | 2002174942 | A * | 6/2002 |

OTHER PUBLICATIONS

U.S. Appl. No. 10/263,802, filed Oct. 4, 2002, Ishibashi et al.
U.S. Appl. No. 10/375,115, filed Feb. 28, 2003, Yamanaka et al.
U.S. Appl. No. 11/276,666, filed Mar. 9, 2006, Takehara et al.
U.S. Appl. No. 11/276,377, filed Feb. 27, 2006, Iwakura et al.

* cited by examiner

*Primary Examiner*—Robert Beatty
(74) *Attorney, Agent, or Firm*—Oblon, Spivak, McClelland, Maier & Neustadt, P.C.

(57) ABSTRACT

An electrophotographic color image forming apparatus of the present invention includes a plurality of image forming sections each including an image carrier and image transferring means. Toner images of different colors are sequentially transferred from the image carriers to a sheet being conveyed by an endless belt while electrostatically adhering to the belt, completing a color toner image. Assuming that the surface of each image carrier and that of the belt move at speeds of Vd and Vb, respectively, a ratio of Vb/Vd can be varied by the user of the apparatus. In addition, assuming that a surface of an intermediate transferring mechanism and a surface of a recording medium move at speeds of Vp and Vi, respectively, the ratio of Vp/Vi can be varied by the user.

40 Claims, 5 Drawing Sheets

COLOR IMAGE FORMING APPARATUS HAVING A VARIABLE CONTROLLED SPEED RATIO

BACKGROUND OF THE INVENTION

1. Field of the Invention

The present invention relates to a color copier, color laser printer, color facsimile apparatus or similar color image forming apparatus.

2. Description of the Background Art

A tandem, color image forming apparatus, belonging to a family of color image forming apparatuses, includes four photoconductive drums or image carriers arranged side by side. While a belt is conveying a sheet or recording medium via the drums, toner images of different colors formed on the drums are sequentially transferred to the sheet one above the other by biases applied to bias applying members, completing a color toner image on the sheet. In such an apparatus, the belt conveys the sheet while electrostatically retaining it thereon, so that the surface speed or moving speed of the sheet is equal or substantially equal to the surface speed of the belt.

If the surface speed of the belt and that of the drums are the same as each other, then image transfer is effected only by an electrostatic force. On the other hand, when the surface speed of the belt is made different from the surface speed of the drums, a mechanical peeling force acts in addition to the electrostatic force and obviates defective image transfer. More specifically, when a difference exists between the two surface speeds, desirable image transfer is attainable particularly when toner images of two or more colors are superposed. As far as a monochromatic image is concerned, a toner layer can be easily retained on the surface of a sheet, so that transferability above a certain level is easily achievable. However, when two or more colors are superposed, a toner layer previously transferred to a sheet lowers the transferability of the next toner layer. This problem can be effectively coped with if a difference is provided between the surface speed of the belt and that of the drums.

It is a common practice with a color image forming apparatus configured to enhance transferability of two or more colors to provide a difference between the surface speed of the belt and that of the drums and maintain the difference constant. Stated another way, the above difference is generally not expected to be varied by the user of the apparatus or a service person.

It has been customary with an electrophotographic, color image forming apparatus to sequentially transfer toner images of different colors to a single sheet one above the other for thereby forming a color image. Regarding this kind of apparatus, Japanese Patent No. 2,743,359 discloses an image transferring device capable of preventing an image from being distorted at the time of transfer. The image transferring device taught in this document allows toner images of different colors to be transferred to a sheet in accurate register without resorting to high dimensional accuracy even when a plurality of drums are used. More specifically, the image transferring device is applied to a tandem, color image forming apparatus in which toner images are sequentially transferred from a plurality of drums to a sheet being carried by an image transfer body before the image transfer body completes one rotation. The surface speed of the image transfer body is made higher than the surface speed of the drums by 0.1% to 1%. A flexible member is fitted on the circumference of the image transfer body and elastically pressed against the drums.

However, the Japanese Patent mentioned above simply teaches a method capable of maintaining the speed of a sheet constant without regard to the extension or the positional shift of an image that may occur due to a difference in diameter between the drums or the eccentricity of the drums. Further, the above document does not show or describe a method of varying a speed ratio in accordance with the mode. In this connection, a method of enhancing transferability by providing a difference between the speed of an image transfer belt, which bifunctions as a conveyor, and the speed of the drums is conventional with a monochromatic copier.

Japanese Patent Laid-Open Publication No. 11-52794 relates to an image forming apparatus of the type providing a difference between the peripheral speed of drums and that of an endless image transfer belt, e.g., an intermediate image transfer belt. This document contemplates to obviate color shift, color change and other defects ascribable to the relative position of the drums and belt that varies color by color, thereby stably producing high-quality color images.

More specifically, in the Laid-Open Publication mentioned above, the belt is provided with a circumferential length which is non-integral times as great as the circumference of the individual drum. Further, assume that each drum has a circumference of Ld and moves at a peripheral speed of Vd, that the belt has a circumferential length of Lb and moves at a peripheral speed of Vb, that a speed difference ratio of the belt to the drum is $\Delta V$ ($\neq 0$), and that n is an integer. Then, the above document defines the relation between the circumferential length of the belt and the circumference of the drum as:

$$Vb = Vd \times (1 + \Delta V)$$

$$Lb = Ld \times (1 + \Delta V) \times n$$

With this scheme, however, it is difficult to surely reduce color shift when the speed of a sheet minutely varies due to the influence of the difference in speed between the belt and the drums, which is ascribable to a change in the kind of a sheet or the variation of temperature or that of humidity. Moreover, the above document does not teach a method of varying the speed ratio in accordance with the mode.

As stated above, by providing a difference in speed between the belt and the drums, it is possible to obviate a vermicular image, e.g., characters blank inside and to enhance transferability of two or more colors. However, although a sheet is usually expected to electrostatically adhere to the belt, the above difference is apt to reduce the adhesion and thereby make the conveying speed of the sheet from coinciding with the conveying speed of the belt, bringing about color shift in the subscanning direction. More specifically, the adhesion of the sheet to the belt is dependent on the kind of a sheet and humidity, so that optimum conditions, sufficiently taking account of humidity and the kind of a sheet, must be set and maintained in order to obviate such color shift.

SUMMARY OF THE INVENTION

It is an object of the present invention to provide a color image forming apparatus allowing the user of the apparatus to select optimum image forming conditions to the user's taste.

An electrophotographic color image forming apparatus of the present invention includes a plurality of image forming sections each including an image carrier and image transferring means. Toner images of different colors are sequentially transferred from the image carriers to a sheet being conveyed by an endless belt while electrostatically adhering to the belt, completing a color toner image. Assuming that the surface of each image carrier and that of the belt move at speeds of Vd and Vb, respectively, then a ratio of Vb/Vd can be varied by the user of the apparatus.

BRIEF DESCRIPTION OF THE DRAWINGS

The above and other objects, features and advantages of the present invention will become more apparent from the following detailed description taken with the accompanying drawings in which.

DESCRIPTION OF THE PREFERRED EMBODIMENTS

Figure 1:
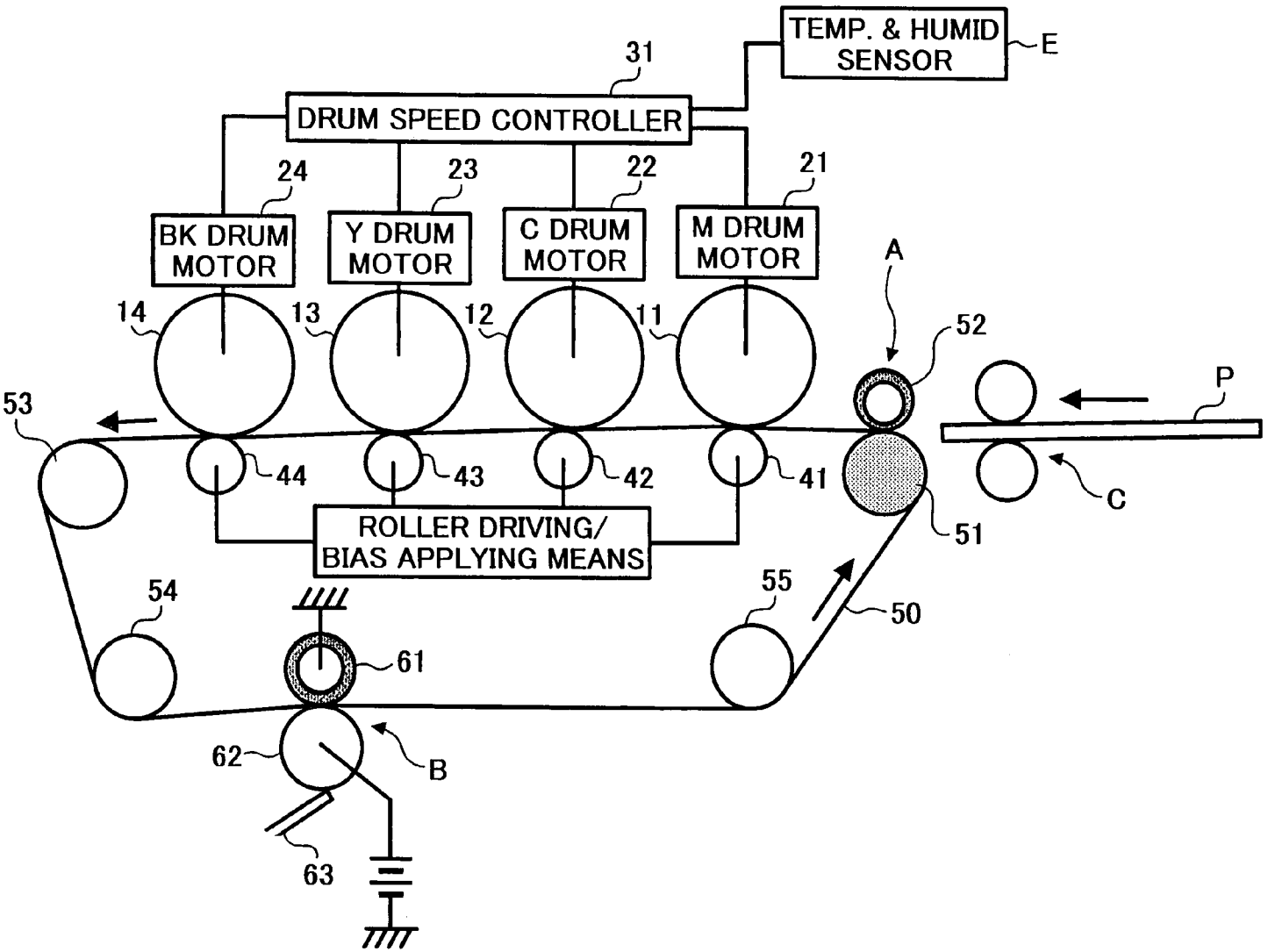
FIG. 1 is a view showing a first embodiment of the color image forming apparatus in accordance with the present invention and implemented as a direct image transfer type of tandem, color image forming apparatus.

Referring to FIG. 1 of the drawings, a direct image transfer type of tandem, electrophotographic color image forming apparatus representative of a first embodiment of the present invention is shown. As shown, the color image forming apparatus includes a plurality of image forming sections respectively including photoconductive drums or images carriers 11 through 14 and image transfer rollers or image transferring means 41 through 44. When an endless belt 50 conveys a sheet or recording medium P while electrostatically retaining it thereon, toner images of different colors formed on the drums 11 through 14 are sequentially transferred to the sheet P by the image transfer rollers 41 through 44, respectively.

Assume that the surface of each of the drums 11 through 14 move at a speed of Vd, and that the surface of the belt 50 moves at a speed of Vb. Then, in the illustrative embodiment, a drum speed controller 31 controls the rotation speed of the drums 11 through 14 while maintaining the speed of the belt 50 constant, thereby maintaining a ratio of Vb/Vd, i.e., a difference between the ratio Vb/Vd and "1" adequate.

More specifically, the drums 11, 12, 13 and 14 are assigned to magenta (M), cyan (C), yellow (Y) and black (BK), respectively, and arranged side by side in the direction in which the belt 50 conveys the sheet P, as indicated by an arrow in FIG. 1. An M drum motor 21, a C drum motor 22, a Y drum motor 23 and a BK drum motor 24 respectively cause the M, C, Y and BK drums to rotate. The drum motors 21 through 24 are connected to the drum speed controller 31, so that the rotational speeds of the drums 11 through 14 can be controlled independently of each other or controlled to a preselected value together. The drum speed controller 31 therefore serves to vary the ratio Vb/Vd. Roller driving/bias applying means F applies a bias for image transfer to each of the image transfer rollers 41 through 44, which are positioned beneath the drums 11 through 14, respectively.

A drive roller 51 causes the belt 50 to move from the M drum 11 toward the BK drum 14 at a constant speed at all times. More specifically, the belt 50 is caused to sequentially move via a nip between the drive roller 51 and a sheet adhering roller 52, nips between the drums 11 through 14 and the image transfer rollers 41 through 44, guide rollers or idle rollers 53 and 54, a nip between a discharge roller 61 and a roller 62 facing it, and a guide roller or idle roller 55 in this order.

The nip between the drive roller 51 and the sheet adhering roller 52 forms a sheet adhering position A. The nip between the discharge roller 61 and the roller 62 forms a cleaning position B in cooperation with a cleaning blade 63. The discharge roller 61 removes residual static electricity left on the belt 50. At the cleaning position B, the cleaning blade 63 is held in contact with the roller 62 so as to remove and collect residual toner also left on the belt 50 via the roller 62. A pair of registration rollers are positioned upstream of the sheet attracting position A in the direction of conveyance of the sheet P, forming a registering position C. The sheet P is conveyed to the sheet attracting position A via the registering position C.

A temperature and humidity sensing section E is connected to the drum speed controller 31. Sensing temperature and humidity inside the apparatus, the temperature and humidity sensing section E sends temperature and humidity data to the drum speed controller 31, so that the drum speed controller 31 can match the drum rotation speed to temperature and humidity sensed.

In operation, the sheet P is electrostatically adhered to the belt 50 at the sheet adhering position A. While the sheet P is conveyed by the belt 50 from the M drum 11 toward the BK drum 14, toner of different colors are sequentially transferred from the drums 11 through 14 to the sheet P one above the other. At the time when the sheet P moves away from the nip between the BK drum 14 and the image transfer roller 44, a color toner image has been completed on the sheet P. The color toner image is fixed on the sheet P at a fixing station not shown.

A method of measuring the Vb/Vd value will be described hereinafter. So long as the sheet P is adequately, electrostatically adhered to the belt 50, the surface speed of the belt 50 and that of the sheet P may be considered to be equal to each other. Therefore, to measure the surface speed of the belt 50, marks are provided at an adequate portion of the belt surface at equal intervals. In this condition, as a sensor senses the marks, the surface speed of the belt 50 is determined on the basis of the intervals of the marks and time intervals in which the sensor senses the marks. This is also true with the surface speed of each drum, i.e., marks are provided on the drum at equal intervals. However, such a method is not easily applicable to an actual machine except for an experimental purpose.

In light of the above, I devised a simple method of determining the Vb/Vd value to be described hereinafter. A lattice pattern with equal intervals is formed on the drum. The intervals of the lattice thus formed on the drum are measured in the subscanning direction. Also, the intervals of the lattice transferred to the belt are measured. In this condition, the Vb/Vd value of an actual machine is determined by using the following relation:

belt surface speed/drum surface speed=belt lattice interval/drum lattice interval In accordance with the new method stated above, the lattice interval on the drum increases with an increase in drum surface speed or decreases with a decrease in drum surface speed.

Figure 2:
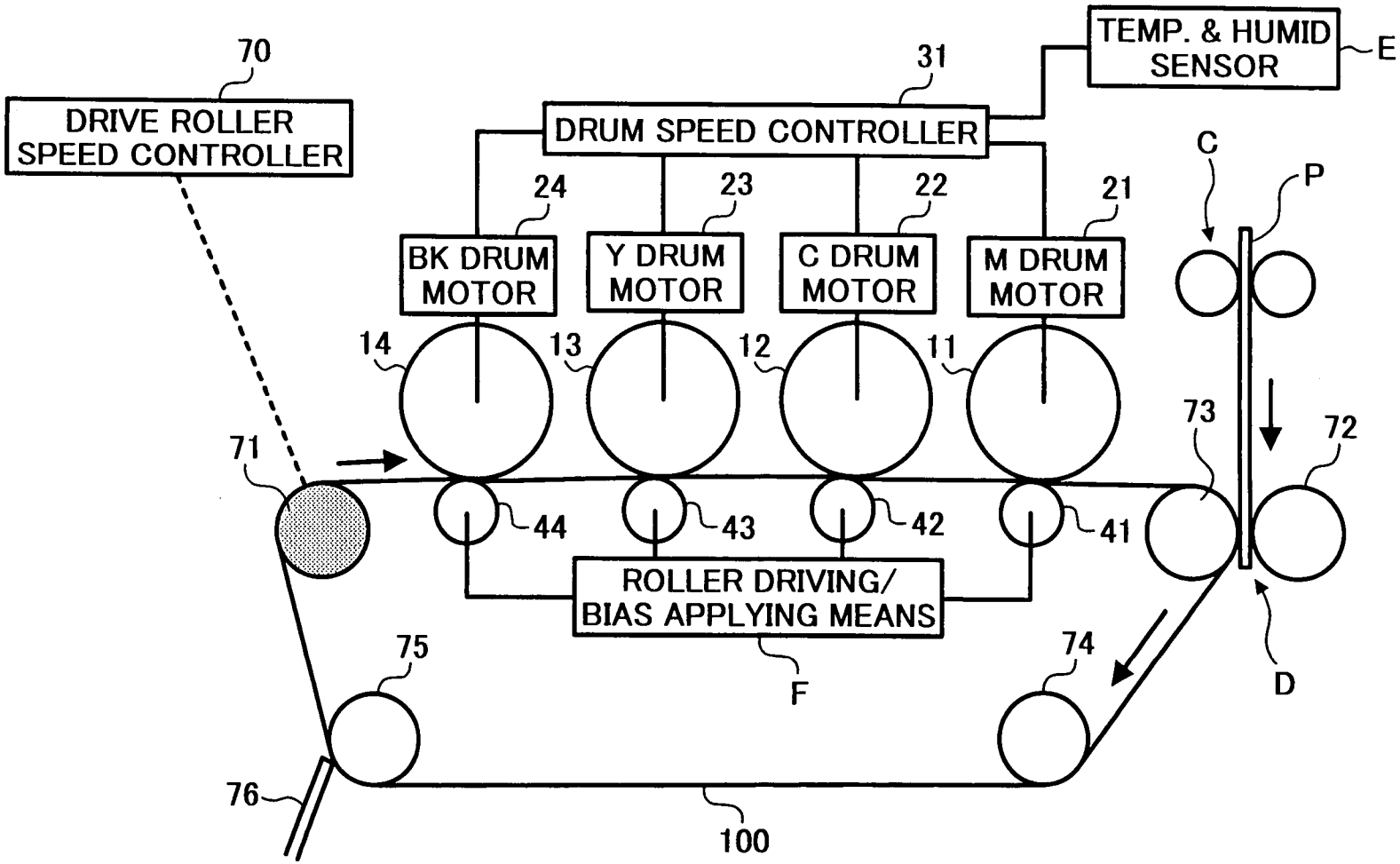
FIG. 2 is a view similar to FIG. 1, showing a second embodiment of the color image forming apparatus in accordance with the present invention and implemented as an intermediate image transfer type of tandem, color image forming apparatus.

FIG. 2 shows an intermediate or indirect image transfer type of tandem, electrostatic color image forming apparatus representative of a second embodiment of the present invention. As shown, the BK drum 14 through M drum 11 are sequentially arranged in this order from the upstream side to the downstream side in the direction in which an endless, intermediate image transfer belt 100 moves. The BK drum motor 24, Y drum motor 23, C drum motor 22 and M drum motor 21 drive the BK drum 14, Y drum 13, C drum 12 and M drum 11, respectively. Again, the drum motors 21 through 24 are connected to the drum speed controller 31, so that the rotational speeds of the drums 11 through 14 can be controlled independently of each other or controlled to a preselected value together. The image transfer rollers, or primary image transferring means, 41 through 44 are positioned beneath the drums 11 through 14, respectively, and applied with an image transfer bias from the roller driving/bias applying means F each.

A drive roller 71 causes the intermediate image transfer belt 100 to move from the BK drum 14 toward the M drum 11 at a constant speed. More specifically, the belt 100 is caused to sequentially move via the drive roller 71, the nips between the drums 14 through 11, a secondary image transfer position D between a secondary image transfer roller 72 and a roller 73 facing it, and guide rollers 74 and 75. A drive roller speed controller 70 is capable of varying the rotation of the drive roller 71 for thereby varying a Vp/Vi value where Vp and Vi respectively denote the surface speed of the sheet P, as measured at a registering position C, and that of the belt 100. The sheet is conveyed to the secondary image transfer position D via the registering position C. A cleaning blade 76 is held in contact with part of the belt 100 passed over the guide roller 75 in order to remove residual toner left on the belt 100.

In operation, toner images of different colors are sequentially transferred from the drums 14*d* through 11 to the belt 100 one above the other while the belt 100 is in movement, forming a color toner image on the belt 100. The color toner image is transferred from the belt 100 to the sheet P conveyed to the secondary image transfer position D via the registering position C. After such secondary image transfer, the cleaning blade 76 removes toner left on the belt 100. The color toner image on the sheet P is fixed at a fixing station not shown.

Examples of the first and second embodiments will be described hereinafter.

EXAMPLE 1

First Embodiment

Figure 3:
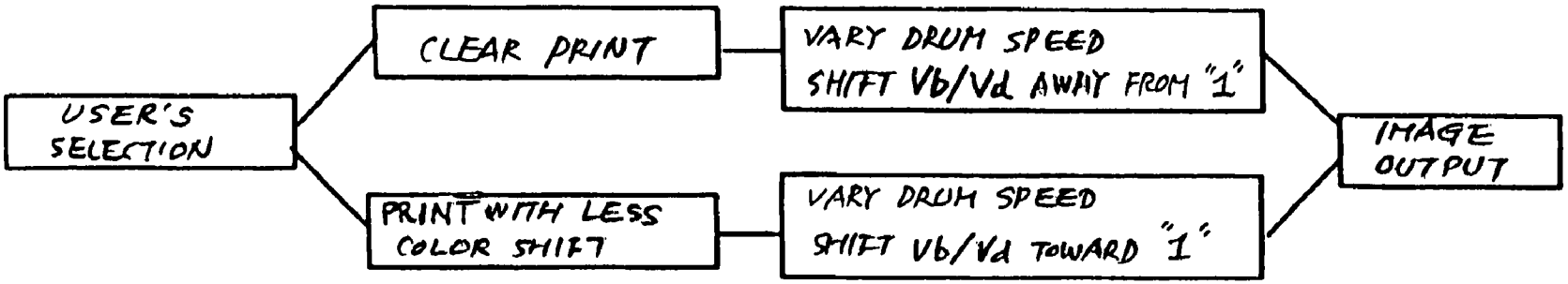
FIG. 3 demonstrates a specific image forming method available with the first embodiment.

In FIG. 1, the belt 50 is held in contact with the four drums 11 through 14. A charge is applied to the sheet P via the sheet adhering roller 52 for thereby causing the sheet P to electrostatically adhere to the belt 50. Toner images of different colors are sequentially transferred from the drums 11 to 14 to the belt 50, which is moving while retaining the sheet P thereon. In this case, the adhesion of the sheet P to the belt 50 increases toward the downstream side because of image transfer currents applied at the consecutive image transfer positions. FIG. 3 shows a specific method of forming a color image used in Example 1.

Figure 4:
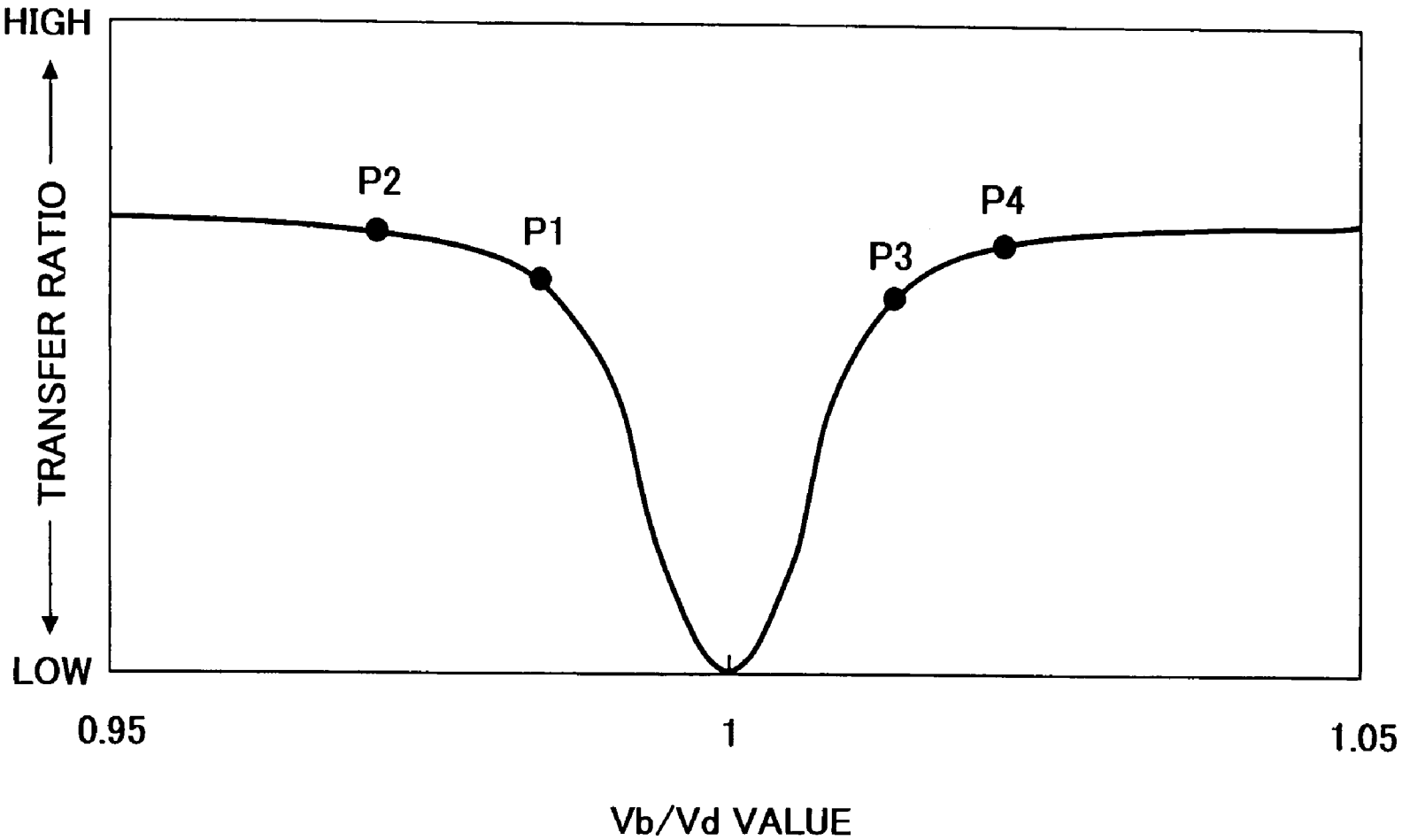
FIG. 4 is a graph showing a relation between the ratio of the surface speed Vd of a belt to the surface speed Vd of a photoconductive drum and the transfer ratio of a toner image to a sheet.
Figure 5:
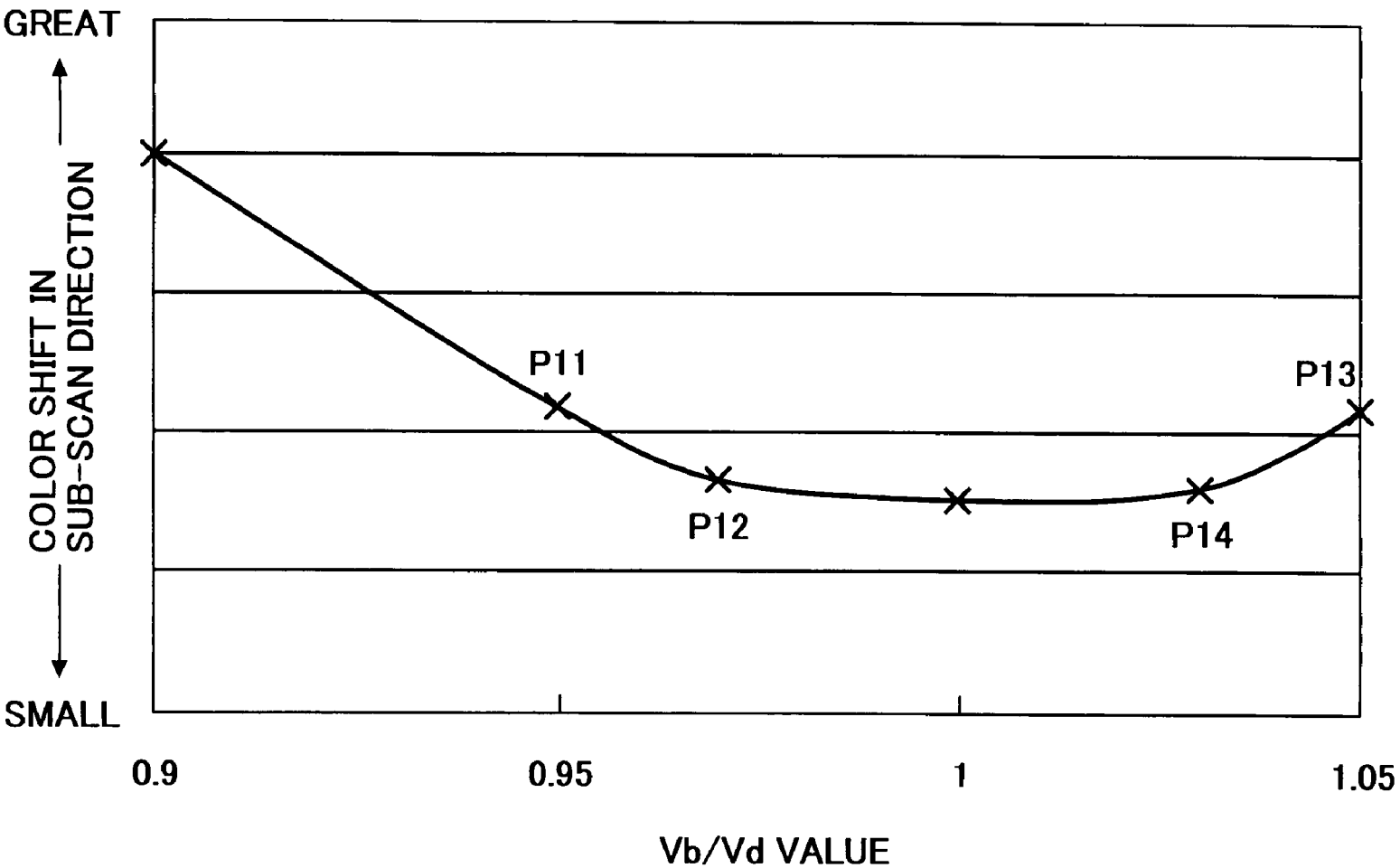
FIG. 5 is a graph showing a relation between the above ratio and the amount of color shift on a sheet in the subscanning direction.

FIGS. 4 and 5 are graphs showing experimental results relating to image formation effected by the apparatus of FIG. 1. More specifically, FIG. 4 is a graph showing a relation between the Vb/Vd value and the image transfer ratio to a sheet while FIG. 5 is a graph showing a relation between the Vb/Vd value and the amount of color shift in the subscanning direction. As FIG. 4 indicates, the image transfer ratio to a sheet increases as the Vb/Vd value increases or decreases from "1". On the other hand, as FIG. 5 indicates, the amount of color shift in the subscanning direction increases as the Vb/Vd value increases or decreases from "1". It is to be noted that the tendency of color shift is dependent on the kind of a sheet, environmental conditions, particularly humidity, a process linear velocity and so forth.

As stated above, the image transfer ratio and the amount of color shift are not compatible with respect to the Vb/Vd value. In light of this, in Example 1, an adequate Vb/Vd value is set in accordance with priority given to either one of the increase of image transfer ratio and the decrease of color shift. More specifically, as shown in FIG. 3, the user of the apparatus, desiring "clear print (higher image transfer ratio)", shifts the Vb/Vd value to an adequate value farther from "1", e.g., shifts it from P1 to P2 or from P3 to P4 shown in FIG. 4. On the other hand, the user, desiring "print with less color shift", shifts the Vb/Vd value to a value closer to "1", e.g., shifts it from P11 to P12 or from P13 to P14 shown in FIG. 5.

In any case, the drum speed controller 31 controls the rotation speed of the drums 11 through 14 to a preselected value. On the other hand, the moving speed of the belt 50 is maintained constant.

More specifically, the belt speed Vb and drum speed Vd are respectively selected to be, e.g., 125 mm/sec and 127 mm/sec at the time of shipment from a factory, establishing a Vb/Vd value of 0.984. This Vb/Vd value is selected by a designer on the assumption of the most general environment of use of the apparatus and the kind of sheets of frequent use such that even when the drum speed and belt speed differ from each other, the amount of color shift and the quality of the resulting color image each lie in a particular allowable range.

Assume that the user of the apparatus desires a clear-cut bicolor image, desires an image free from granularity or desires to obviate a vermicular image, e.g., characters blank inside. Then, the user selects "clear print" on the apparatus before image formation, so that the actual Vb/Vd value is shifted away from "1" more than the Vb/Vd value of 0.984 set at the factory. In this case, the drum speed Vd is varied from 127 mm/sec to 129 mm/sec so as to reduce the Vb/Vd value to 125/129=0.969; $(1-0.984)<(1-0.969)$.

On the other hand, when the user desires to reduce the amount of color shift of a composite toner image, the user selects "print with less color shift" on the apparatus. As a result, the drum speed Vd is varied from 127 mm/sec to 125 mm/sec so as to increase the Vb/Vd value to 125/125=1.

When the drum speed Vd is varied alone as in the illustrative embodiment, it is not necessary to vary the sheet conveying speed at any one of the registering position, sheet adhering position and fixing position because the belt speed Vb remains the same. In addition, the number of prints to be output for a unit time, for example, does not increase or decrease. Alternatively, only the belt speed Vb may be varied, in which case a belt speed controller, not shown, will be added to the construction of FIG. 1. Further, the drum speed Vd and belt speed Vb both may be varied, if desired. The belt speed Vb can be varied in the same manner as the drum speed Vd only if the amount of variation of sheet conveying speed at each of the registering position C and fixing position is estimated beforehand and reflected.

EXAMPLE 2

First Embodiment

In Example 1 described above, the Vb/Vd value is varied on the basis of user's mode selection. In practice, however, it is desirable to set image forming conditions while confirming the balance of image quality by eye. For this purpose, in Example 2, a service person or a person, expected to maintain the apparatus or deal with image defects and other troubles in the market, selects a maintenance mode on the apparatus and then varies the Vb/Vd value. For example, the person varies, while referencing a Vb/Bd table, the Vb/Vd value between 0.95 and 1.05 by a step of 0.005 on buttons arranged on the apparatus. In this case, it is more preferable to switch the drum speed Vd than the belt speed Vb because when the drum speed Vd is switched, the sheet conveying speed does not vary and therefore reduces adverse influence ascribable to the handover of a sheet to another unit.

EXAMPLE 3

First Embodiment

Assume that a color image forming apparatus allows the Vb/Vd value to be varied in accordance with the process linear velocity and has, e.g., two process linear velocities of 100 mm/sec and 200 mm/sec. Then, the Vb/Vd value is selected to be 1±0.003 for the conveying speed of 100 mm/sec or 1.03 to 1.06 or 0.94 to 0.97 for the conveying speed of 200 mm/sec. In this manner, the Vb/Vd value assigned to the lower process linear velocity, which tends to cause the electrostatic attraction of a sheet to the belt to decrease with the elapse of time, is made closer to "1" in order to obviate color shift.

EXAMPLE 4

First Embodiment

In an image forming apparatus configured to vary the Vb/Vd value in accordance with the kind of a sheet, i.e., a sheet conveying mode, the Vb/Vd value is varied only when a thick sheet or similar special sheet is used for thereby obviating defective images. This allows the user to easily achieve images to the user's taste.

EXAMPLE 5

Second Embodiment

Even in the apparatus shown in FIG. 2, a relation between the Vp/Vi value and the image transfer ratio and a relation between the Vp/Vi value and the amount of color shift in the subscanning direction are similar to the relations shown in FIGS. 4 and 5, respectively, as determined by experiments. More specifically, the image transfer ratio to a sheet increases as the Vp/Vi value increases or decreases from "1". On the other hand, the amount of color shift in the subscanning direction increases as the Vp/Vi value increases or decreases from "1". In this manner, the image transfer ratio and the amount of color shift are not compatible with respect to the Vp/Vi value. In light of this, in Example 5, an adequate Vp/Vi value is set in accordance with priority given to either one of the increase of image transfer ratio and the decrease of color shift.

In Example 5, the user of the apparatus selects "clear print" before image formation when desiring a bicolor image clearer than at the time of shipment, a less granular image or an image free from vermiculation. As a result, the actual Vp/Vi value is shifted away from "1" more than the value set at the time of shipment. On the other hand, the user selects "print with less color shift" when desiring to reduce the amount of color shift more than at the time of shipment. As a result, the actual Vp/Vi value is shifted toward "1" more than the value set at the time of shipment. Further, to obviate a vermicular image, i.e., to increase the image transfer ratio to a sheet in relation to the kind of the sheet, the user again shifts the actual Vp/Vi value away from "1" more than the set value.

In Example 5, only the belt speed Vi is varied by the drive roller speed controller 70, FIG. 2, for varying the Vp/Vi value, as stated above. This successfully simplifies the structure of the apparatus and user's operation for image formation. Alternatively, the sheet speed Vp at the registering position C may be varied alone or the belt speed Vp and sheet speed Vi both may be varied, if desired.

EXAMPLE 6

Second Embodiment

In Example 6, a ratio Vi/Vd is varied, as will be described hereinafter. The user of the apparatus selects "clear print" before image formation when desiring a bicolor image clearer than at the time of shipment, a less granular image or an image free from vermiculation. As a result, the actual Vi/Vd value is shifted away from "1" more than the value set at the time of shipment. On the other hand, the user selects "print with less color shift" when desiring to reduce the amount of color shift more than at the time of shipment. As a result, the actual Vi/Vd value is shifted toward "1" more than the value set at the time of shipment. Further, to obviate a vermicular image, i.e., to increase the image transfer ratio to a sheet in relation to the kind of the sheet, the user again shifts the actual Vi/Vd value away from "1" more than the set value.

In summary, it will be seen that the present invention provides a color image forming apparatus having various unprecedented advances, as enumerated below.

(1) The user of the apparatus is capable of varying any one of the Vb/Vd value, Vp/Vi value and Vi/Vd value, as desired. Therefore, when the user desires to reduce minute color shift of an image or to obviate a vermicular image ascribable to a rough sheet, the user can select optimum conditions to the user's taste without relying on, e.g., a service person and without regard to the environment of use of the apparatus or the kind of a sheet to use.

(2) A service person or a person, expected to deal with troubles liable to occur in the apparatus, is capable of varying any one of the Vb/Vd, Vp/Vi and Vi/Vd values. Therefore, when image forming conditions are shifted from the optimal image quality conditions due to the kind of a sheet or the environment, the above person can rapidly restore the optimum image quality conditions at the site.

(3) Any one of the Vb/Vd, Vp/Vi and Vi/Vd values can be set for each of different process linear velocities and is therefore variable only on a process linear velocity shifted from the optimum image-quality conditions.

(4) Any one of the Vb/Vd, Vp/Vi and Vi/Vd values can be set for each of different kinds of sheets, e.g., a plain paper sheet, a thick sheet, an OHP (OverHead Projector) film and a postcard. This allows image forming conditions not adequate for any one of the different kinds of sheets to adapt to the kind of sheets.

(5) With the above advantages (1) through (4), it is possible for the user to stably attain high-quality images matching the user's taste.

(6) High-quality images are stably achievable even with a direct image transfer type of color image forming apparatus which is apt to bring about color shift and other image defects.

Various modifications will become possible for those skilled in the art after receiving the teachings of the present disclosure without departing from the scope thereof.

What is claimed is:

1. An electrophotographic image forming apparatus comprising:

a drum speed controller; and an image forming section including, an image carrier configured to carry a toner image and a lattice having equal intervals, an endless belt, and an image transferring means configured to transfer the toner image from said image carrier to a recording medium conveyed by the endless belt and electrostatically adhered to said belt, said image transfer means further configured to transfer the lattice pattern to the belt, wherein a surface of said image carrier and a surface of said belt are configured to move at a speed of Vd and a speed of Vb, respectively, and the drum speed controller is configured to control a ratio Vd/Vb based on a relation (Vb/Vd)=(belt lattice interval/drum lattice interval), and the ratio of Vb/Vd is variable by a user of said image forming apparatus.

2. The apparatus as claimed in claim 1, wherein said image forming section comprises a plurality of image forming sections each being assigned to a particular color.

3. The apparatus as claimed in claim 1, wherein said image carrier and said image transferring means comprise a photoconductive drum and an image transfer roller, respectively.

4. An electrophotographic image forming apparatus comprising:

a drum speed controller; and an image forming section including, an image carrier configured to carry a toner image and a lattice having equal intervals, an endless belt, and an image transferring means configured to transfer the toner image from said image carrier to a recording medium conveyed by the endless belt and electrostatically adhered to said belt, said image transfer means further configured to transfer the lattice pattern to the belt, wherein a surface of said image carrier and a surface of said belt are configured to move at a speed of Vd and a speed of Vb, respectively, and the drum speed controller is configured to control a ratio Vd/Vb based on a relation (Vb/Vd)=(belt lattice interval/drum lattice interval), and the ratio of Vb/Vd is variable by a either a service person or a person expected to deal with troubles of said image forming apparatus.

5. The apparatus as claimed in claim 4, wherein said image forming section comprises a plurality of image forming sections each being assigned to a particular color.

6. The apparatus as claimed in claim 4, wherein said image carrier and said image transferring means comprise a photoconductive drum and an image transfer roller, respectively.

7. An electrophotographic image forming apparatus comprising:

a drum speed controller; and an image forming section including, an image carrier configured to carry a toner image and a lattice having equal intervals, an endless belt, and an image transferring means configured to transfer the toner image from said image carrier to a recording medium conveyed by the endless belt and electrostatically adhered to said belt, said image transfer means further configured to transfer the lattice pattern to the belt, wherein a surface of said image carrier and a surface of said belt are configured to move at a speed of Vd and a speed of Vb, respectively, and the drum speed controller is configured to control a ratio Vd/Vb based on a relation (Vb/Vd)=(belt lattice interval/drum lattice interval), and the ratio of Vb/Vd is variable based on each of a plurality of process linear velocities.

8. The apparatus as claimed in claim 7, wherein said image forming section comprises a plurality of image forming sections each being assigned to a particular color.

9. The apparatus as claimed in claim 7, wherein said image carrier and said image transferring means comprise a photoconductive drum and an image transfer roller, respectively.

10. An electrophotographic image forming apparatus comprising:

a drum speed controller; and an image forming section including, an image carrier configured to carry a toner image and a lattice having equal intervals, an endless belt, and an image transferring means configured to transfer the toner image from said image carrier to a recording medium conveyed by the endless belt and electrostatically adhered to said belt, said image transfer means further configured to transfer the lattice pattern to the belt, wherein a surface of said image carrier and a surface of said belt are configured to move at a speed of Vd and a speed of Vb, respectively, and the drum speed controller is configured to control a ratio Vd/Vb based on a relation (Vb/Vd)=(belt lattice interval/drum lattice interval), and the ratio of Vb/Vd is variable in accordance with a kind of the recording medium.

11. The apparatus as claimed in claim 10, wherein said image forming section comprises a plurality of image forming sections each being assigned to a particular color.

12. The apparatus as claimed in claim 10, wherein said image carrier and said image transferring means comprise a photoconductive drum and an image transfer roller, respectively.

13. An electrophotographic color image forming apparatus comprising:

a plurality of image forming sections, which include an image carrier and primary image transferring means each, arranged side by side in a direction of movement of endless intermediate image transferring means for sequentially transferring toner images from individual image carriers to said intermediate image transferring means with primary image transferring means and then transferring a resulting composite toner image from said intermediate image transferring means to a recording medium being conveyed at a secondary image transfer position, wherein a surface of said intermediate image transferring means and a surface of said recording medium move at a speed of Vi and a speed of Vp, respectively, and a ratio of Vp/Vi is variable from a value greater than one to a value less than 1 by a user of said image forming apparatus via a user input configured to set the ratio during operation of the electrophotographic color image forming apparatus.

14. The apparatus as claimed in claim 13, wherein said image carriers, said primary image transferring means and said intermediate image transferring means comprise photoconductive drums, image transfer rollers and an intermediate image transfer belt, respectively.

15. An electrophotographic color image forming apparatus comprising:

a plurality of image forming sections, which include an image carrier and primary image transferring means each, arranged side by side in a direction of movement of endless intermediate image transferring means for sequentially transferring toner images from individual image carriers to said intermediate image transferring means with primary image transferring means and then transferring a resulting composite toner image from said intermediate image transferring means to a recording medium being conveyed at a secondary image transfer position, wherein a surface of said intermediate image transferring means and a surface of said recording medium move at a speed of Vi and a speed of Vp, respectively, and a ratio of Vp/Vi is variable from a value greater than one to a value less than 1 by a service person or a person expected to deal with troubles of said image forming apparatus via a service input configured to set the ratio during operation of the electrophotographic color image forming apparatus.

16. The apparatus as claimed in claim 15, wherein said image carriers, said primary image transferring means and said intermediate image transferring means comprise photoconductive drums, image transfer rollers and an intermediate image transfer belt, respectively.

17. An electrophotographic color image forming apparatus comprising:

a plurality of image forming sections, which include an image carrier and primary image transferring means each, arranged side by side in a direction of movement of endless intermediate image transferring means for sequentially transferring toner images from individual image carriers to said intermediate image transferring means with primary image transferring means and then transferring a resulting composite toner image from said intermediate image transferring means to a recording medium being conveyed at a secondary image transfer position, wherein a surface of said intermediate image transferring means and a surface of said recording medium move at a speed of Vi and a speed of Vp, respectively, a ratio of Vp/Vi is variable from a value greater than one to a value less than 1 via a user input configured to set the ratio during operation of the electrophotographic color image forming apparatus for each of a plurality of process linear velocities.

18. The apparatus as claimed in claim 17, wherein said image carriers, said primary image transferring means and said intermediate image transferring means comprise photoconductive drums, image transfer rollers and an intermediate image transfer belt, respectively.

19. An electrophotographic color image forming apparatus comprising:

a plurality of image forming sections, which include an image carrier and primary image transferring means each, arranged side by side in a direction of movement of endless intermediate image transferring means for sequentially transferring toner images from individual image carriers to said intermediate image transferring means with primary image transferring means and then transferring a resulting composite toner image from said intermediate image transferring means to a recording medium being conveyed at a secondary image transfer position, wherein a surface of said intermediate image transferring means and a surface of said recording medium move at a speed of Vi and a speed of Vp, respectively, a ratio of Vp/Vi is variable from a value greater than one to a value less than 1 in accordance with a kind of the recording medium via a user input configured to set the ratio during operation of the electrophotographic color image forming apparatus.

20. The apparatus as claimed in claim 19, wherein said image carriers, said primary image transferring means and said intermediate image transferring means comprise photoconductive drums, image transfer rollers and an intermediate image transfer belt, respectively.

21. An electrophotographic color image forming apparatus comprising:

a plurality of image forming sections, which include an image carrier and primary image transferring means each, arranged side by side in a direction of movement of endless intermediate image transferring means for sequentially transferring toner images from individual image carriers to said intermediate image transferring means with primary image transferring means and then transferring a resulting composite toner image from said intermediate image transferring means to a recording medium being conveyed at a secondary image transfer position, assuming that a surface of said image carrier and a surface of said intermediate image transferring means move at a speed of Vd and a speed of Vi, respectively, a ratio of Vi/Vd is variable by a user of said image forming apparatus, wherein one image carrier from the plurality of image forming sections carries a lattice having equal intervals and is configured to transfer the lattice to the endless intermediate image transferring means, and wherein a drum speed controller is configured to control the ratio Vi/Vd based on the relation (Vi/Vd)=(belt lattice interval/drum lattice interval).

22. The apparatus as claimed in claim 21, wherein said image carriers, said primary image transferring means and said intermediate image transferring means comprise photoconductive drums, image transfer rollers and an intermediate image transfer belt, respectively.

23. An electrophotographic color image forming apparatus comprising:

a plurality of image forming sections, which include an image carrier and primary image transferring means each, arranged side by side in a direction of movement of endless intermediate image transferring means for sequentially transferring toner images from individual image carriers to said intermediate image transferring means with primary image transferring means and then transferring a resulting composite toner image from said intermediate image transferring means to a recording medium being conveyed at a secondary image transfer position, assuming that a surface of said image carrier and a surface of said intermediate image transferring means move at a speed of Vd and a speed of Vi, respectively, a ratio of Vi/Vd is variable by a service person or a person expected to deal with troubles of said image forming apparatus, wherein one image carrier from the plurality of image forming sections carries a lattice having equal intervals and is configured to transfer the lattice to the endless intermediate image transferring means, and wherein a drum speed controller is configured to control the ratio Vi/Vd based on the relation (Vi/Vd)=(belt lattice interval/drum lattice interval).

24. The apparatus as claimed in claim 23, wherein said image carriers, said primary image transferring means and said intermediate image transferring means comprise photoconductive drums, image transfer rollers and an intermediate image transfer belt, respectively.

25. An electrophotographic color image forming apparatus comprising: a plurality of image forming sections, which include an image carrier and primary image transferring means each, arranged side by side in a direction of movement of endless intermediate image transferring means for sequentially transferring toner images from individual image carriers to said intermediate image transferring means with primary image transferring means and then transferring a resulting composite toner image from said intermediate image transferring means to a recording medium being conveyed at a secondary image transfer position, assuming that a surface of said image carrier and a surface of said intermediate image transferring means move at a speed of Vd and a speed of Vi, respectively, a ratio of Vi/Vd is variable for each of a plurality of process linear velocities, wherein one image carrier from the plurality of image forming sections carries a lattice having equal intervals and is configured to transfer the lattice to the endless intermediate image transferring means, and wherein a drum speed controller is configured to control the ratio Vi/Vd based on the relation (Vi/Vd)=(belt lattice interval/drum lattice interval).

26. The apparatus as claimed in claim 25, wherein said image carriers, said primary image transferring means and said intermediate image transferring means comprise photoconductive drums, image transfer rollers and an intermediate image transfer belt, respectively.

27. An electrophotographic color image forming apparatus comprising: a plurality of image forming sections, which include an image carrier and primary image transferring means each, arranged side by side in a direction of movement of endless intermediate image transferring means for sequentially transferring toner images from individual image carriers to said intermediate image transferring means with primary image transferring means and then transferring a resulting composite toner image from said intermediate image transferring means to a recording medium being conveyed at a secondary image transfer position, assuming that a surface of said image carrier and a surface of said intermediate image transferring means move at a speed of Vd and a speed of Vi, respectively, a ratio of Vi/Vd is variable in accordance with a kind of the recording mediums, wherein one image carrier from the plurality of image forming sections carries a lattice having equal intervals and is configured to transfer the lattice to the endless intermediate image transferring means, and wherein a drum speed controller is configured to control the ratio Vi/Vd based on the relation (Vi/Vd)=(belt lattice interval/drum lattice interval).

28. The apparatus as claimed in claim 27, wherein said image carriers, said primary image transferring means and said intermediate image transferring means comprise photoconductive drums, image transfer rollers and an intermediate image transfer belt, respectively.

29. An electrophotographic image forming method using an image forming section, which includes an image carrier and image transferring means, for transferring a toner image from said image carrier to a recording medium being conveyed by an endless belt while electrostatically adhering to said belt, assuming that a surface of said image carrier and a surface of said belt move at a speed of Vd and a speed of Vb, respectively, a ratio of Vb/Vd is variable by a users, wherein the image carrier carries a lattice having equal intervals and transfers the lattice to the endless belt, and wherein a drum speed controller controls the ratio Vb/Vd based on the relation (Vb/Vd)=(belt lattice interval/drum lattice interval).

30. An electrophotographic image forming method using an image forming section, which includes an image carrier and image transferring means, for transferring a toner image from said image carrier to a recording medium being conveyed by an endless belt while electrostatically adhering to said belt, assuming that a surface of said image carrier and a surface of said belt move at a speed of Vd and a speed of Vb, respectively, a ratio of Vb/Vd is variable by either one of a service person and a person expected to deal with troubles, wherein the image carrier carries a lattice having equal intervals and transfers the lattice to the endless belt, and wherein a drum speed controller controls the ratio Vb/Vd based on the relation (Vb/Vd)=(belt lattice interval/drum lattice interval).

31. An electrophotographic image forming method using an image forming section, which includes an image carrier and image transferring means, for transferring a toner image from said image carrier to a recording medium being conveyed by an endless belt while electrostatically adhering to said belt, assuming that a surface of said image carrier and a surface of said belt move at a speed of Vd and a speed of Vb, respectively, a ratio of Vb/Vd is variable for each of a plurality of process linear velocities, wherein the image carrier carries a lattice having equal intervals and transfers the lattice to the endless belt, and wherein a drum speed controller controls the ratio Vb/Vd based on the relation (Vb/Vd)=(belt lattice interval/drum lattice interval).

32. An electrophotographic image forming method using an image forming section, which includes an image carrier and image transferring means, for transferring a toner image from said image carrier to a recording medium being conveyed by an endless belt while electrostatically adhering to said belt, assuming that a surface of said image carrier and a surface of said belt move at a speed of Vd and a speed of Vb, respectively, a ratio of Vb/Vd is variable in accordance with a kind of the recording mediums, wherein the image carrier carries a lattice having equal intervals and transfers the lattice to the endless belt, and wherein a drum speed controller controls the ratio Vb/Vd based on the relation (Vb/Vd)=(belt lattice interval/drum lattice interval).

33. An electrophotographic color image forming method using a plurality of image forming sections, which include an image carrier and primary image transferring means each, arranged side by side in a direction of movement of endless intermediate image transferring means for sequentially transferring toner images from individual image carriers to said intermediate image transferring means with primary image transferring means and then transferring a resulting composite toner image from said intermediate image transferring means to a recording medium being conveyed at a secondary image transfer position, wherein a surface of said intermediate image transferring means and a surface of said recording medium move at a speed of Vi and a speed of Vp, respectively, and a ratio of Vp/Vi is variable from a value greater than one to a value less than 1 by a user via a user input configured to set the ratio during operation of the electrophotographic color image forming apparatus.

34. An electrophotographic color image forming method using a plurality of image forming sections, which include an image carrier and primary image transferring means each, arranged side by side in a direction of movement of endless intermediate image transferring means for sequentially transferring toner images from individual image carriers to said intermediate image transferring means with primary image transferring means and then transferring a resulting composite toner image from said intermediate image transferring means to a recording medium being conveyed at a secondary image transfer position, wherein a surface of said intermediate image transferring means and a surface of said recording medium move at a speed of Vi and a speed of Vp, respectively, and a ratio of Vp/Vi is variable from a value greater than one to a value less than 1 by a service person or a person expected to deal with troubles via a service input configured to set the ratio during operation of the electrophotographic color image forming apparatus.

35. An electrophotographic color image forming method using a plurality of image forming sections, which include an image carrier and primary image transferring means each, arranged side by side in a direction of movement of endless intermediate image transferring means for sequentially transferring toner images from individual image carriers to said intermediate image transferring means with primary image transferring means and then transferring a resulting composite toner image from said intermediate image transferring means to a recording medium being conveyed at a secondary image transfer position, wherein a surface of said intermediate image transferring means and a surface of said recording medium move at a speed of Vi and a speed of Vp, respectively, and a ratio of Vp/Vi is variable from a value greater than one to a value less than 1 for each of a plurality of process linear velocities via a user input configured to set the ratio during operation of the electrophotographic color image forming apparatus.

36. An electrophotographic color image forming method using a plurality of image forming sections, which include an image carrier and primary image transferring means each, arranged side by side in a direction of movement of endless intermediate image transferring means for sequentially transferring toner images from individual image carriers to said intermediate image transferring means with primary image transferring means and then transferring a resulting composite toner image from said intermediate image transferring means to a recording medium being conveyed at a secondary image transfer position, wherein a surface of said intermediate image transferring means and a surface of said recording medium move at a speed of Vi and a speed of Vp, respectively, and a ratio of Vp/Vi is variable from a value greater than one to a value less than 1, in accordance with a kind of the recording medium, via a user input configured to set the ratio during operation of the electrophotographic color image forming apparatus.

37. An electrophotographic color image forming method using a plurality of image forming sections, which include an image carrier and primary image transferring means each, arranged side by side in a direction of movement of endless intermediate image transferring means for sequentially transferring toner images from individual image carriers to said intermediate image transferring means with primary image transferring means and then transferring a resulting composite toner image from said intermediate image transferring means to a recording medium being conveyed at a secondary image transfer position, assuming that a surface of said image carrier and a surface of said intermediate image transferring means move at a speed of Vd and a speed of Vi, respectively, a ratio of Vi/Vd is variable by a user, wherein the speed Vi is maintained substantially constant one image carrier from the plurality of image forming sections carries a lattice having equal intervals and transfers the lattice to the endless intermediate image transferring means, and wherein a drum speed controller controls the ratio Vi/Vd based on the relation (Vi/Vd)=(belt lattice interval/drum lattice interval).

38. An electrophotographic color image forming method using a plurality of image forming sections, which include an image carrier and primary image transferring means each, arranged side by side in a direction of movement of endless intermediate image transferring means for sequentially transferring toner images from individual image carriers to said intermediate image transferring means with primary image transferring means and then transferring a resulting composite toner image from said intermediate image transferring means to a recording medium being conveyed at a secondary image transfer position, assuming that a surface of said image carrier and a surface of said intermediate image transferring means move at a speed of Vd and a speed of Vi, respectively, a ratio of Vi/Vd is variable by a service person or a person expected to deal with troubles, wherein one image carrier from the plurality of image forming sections carries a lattice having equal intervals and transfers the lattice to the endless intermediate image transferring means, and wherein a drum speed controller controls the ratio Vi/Vd based on the relation (Vi/Vd)=(belt lattice interval/drum lattice interval).

39. An electrophotographie color image forming method using a plurality of image forming sections, which include an image carrier and primary image transferring means each, arranged side by side in a direction of movement of endless intermediate image transferring means for sequentially transferring toner images from individual image carriers to said intermediate image transferring means with primary image transferring means and then transferring a resulting composite toner image from said intermediate image transferring means to a recording medium being conveyed at a secondary image transfer position, assuming that a surface of said image carrier and a surface of said intermediate image transferring means move at a speed of Vd and a speed of Vi, respectively, a ratio of Vi/Vd is variable for each of a plurality of process linear velocities, wherein one image carrier from the plurality of image forming sections carries a lattice having equal intervals and transfers the lattice to the endless intermediate image transferring means, and wherein a drum speed controller controls the ratio Vi/Vd based on the relation (Vi/Vd)=(belt lattice interval/drum lattice interval).

40. An electrophotographic color image forming method using a plurality of image forming sections, which include an image carrier and primary image transferring means each, arranged side by side in a direction of movement of endless intermediate image transferring means for sequentially transferring toner images from individual image carriers to said intermediate image transferring means with primary image transferring means and then transferring a resulting composite toner image from said intermediate image transferring means to a recording medium being conveyed at a secondary image transfer position, assuming that a surface of said image carrier and a surface of said intermediate image transferring means move at a speed of Vd and a speed of Vi, respectively, a ratio of Vi/Vd is variable in accordance with a kind of the recording mediums, wherein one image carrier from the plurality of image forming sections carries a lattice having equal intervals and transfers the lattice to the endless intermediate image transferring means, and wherein a drum speed controller controls the ratio Vi/Vd based on the relation (Vi/Vd)=(belt lattice interval/drum lattice interval).

* * * * *